US005479025A

United States Patent [19]

Huniu et al.

[11] Patent Number: 5,479,025

[45] Date of Patent: Dec. 26, 1995

[54] BORESIGHT THERMAL REFERENCE SOURCE

[75] Inventors: Lee J. Huniu, Torrance; Charles N. Boyar, Los Angeles, both of Calif.

[73] Assignee: Hughes Aircraft Company, Los Angeles, Calif.

[21] Appl. No.: 341,796

[22] Filed: Nov. 18, 1994

[51] Int. Cl.[6] ..... H05B 3/10

[52] U.S. Cl. ..... 250/504 R; 250/493.1; 219/553

[58] Field of Search ..... 250/493.1, 504 R; 219/553

[56] References Cited

U.S. PATENT DOCUMENTS

| | | | |
|---|---|---|---|
| 3,949,231 | 4/1976 | Blunck et al. | 250/493.1 |
| 4,499,382 | 2/1985 | Vincent | 250/504 R |

FOREIGN PATENT DOCUMENTS

| | | | |
|---|---|---|---|
| 2-40515 | 2/1990 | Japan | 250/493.1 |

*Primary Examiner*—Jack I. Berman
*Attorney, Agent, or Firm*—H. P. Gortler; M. W. Sales; W. K. Denson-Low

[57] ABSTRACT

A boresight thermal reference source capable of rapidly providing a uniform high intensity Infra-Red signal, comprises a boresight source housing, a ceramic rod, and a heater wire helically surrounding, at least partially, the ceramic rod. The coiled heater wire has a plurality of turns extending outwardly from one end of the ceramic rod forming a blackbody cavity therein from the plurality of outwardly extending turns on the end of the ceramic rod. The small mass of the ceramic rod, optimum geometry of ceramic rod, heater wire, and housing for reduced heat loss, and the aforementioned blackbody cavity configuration, all provide for low operating power with uniform rapid heating of one end (ceramic floor) of the ceramic rod to about 1000° C. Lastly to maintain geometry and precisely locate the signal, the heater wire and ceramic rod are held firmly in place by threading of the wire, both the heater wire and a twist wire, through a plurality of holes and slots in the boresight source housing and ceramic rod.

16 Claims, 2 Drawing Sheets

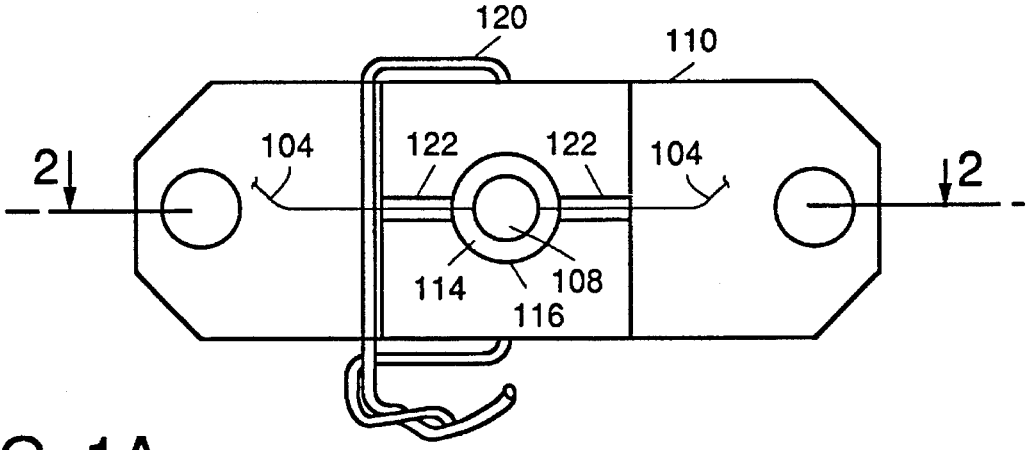
FIG. 1A.
FIG. 1B.
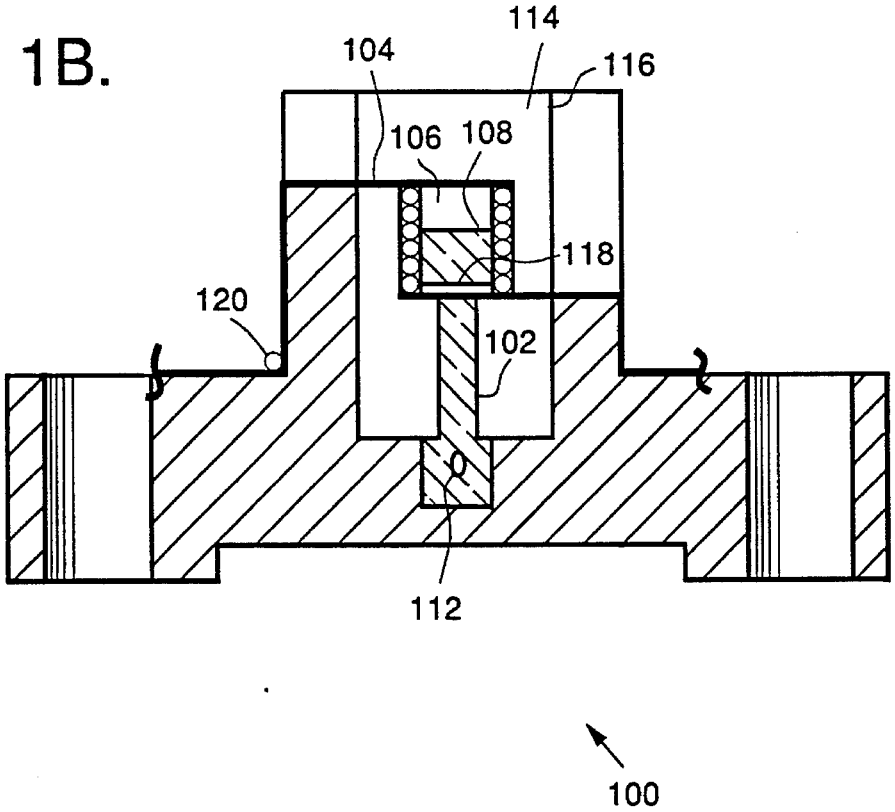

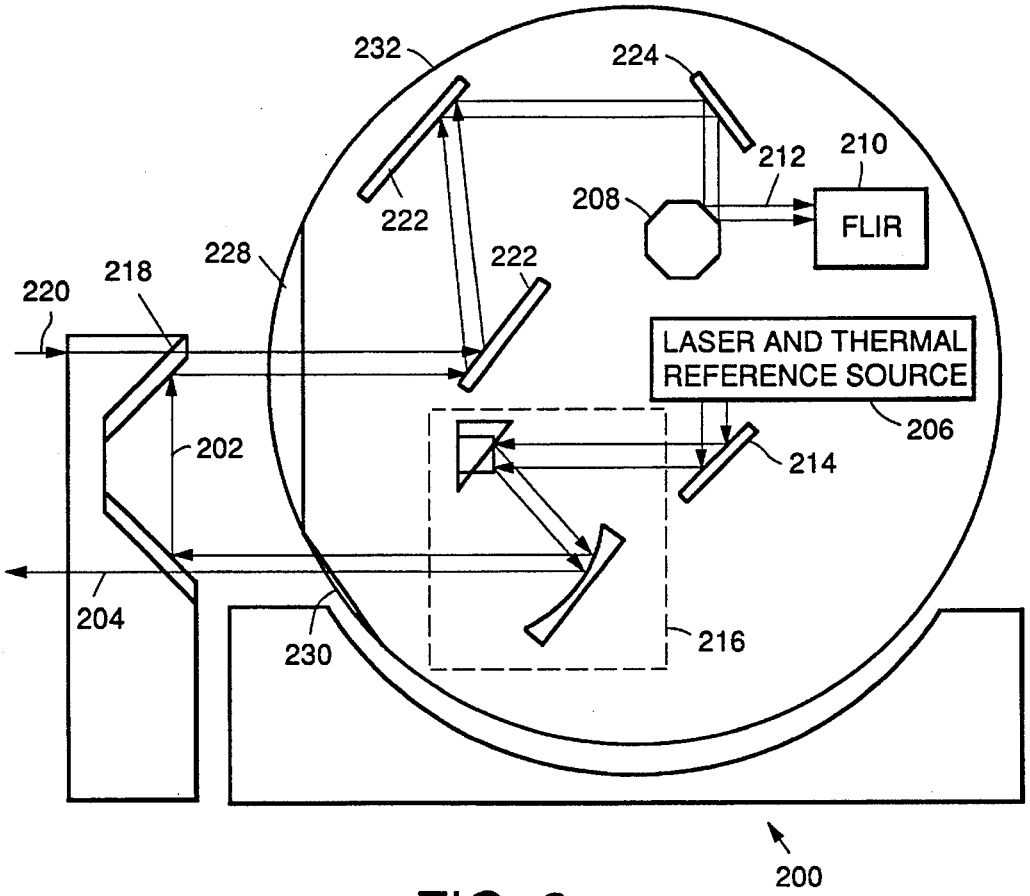
FIG. 2.
FIG. 3.
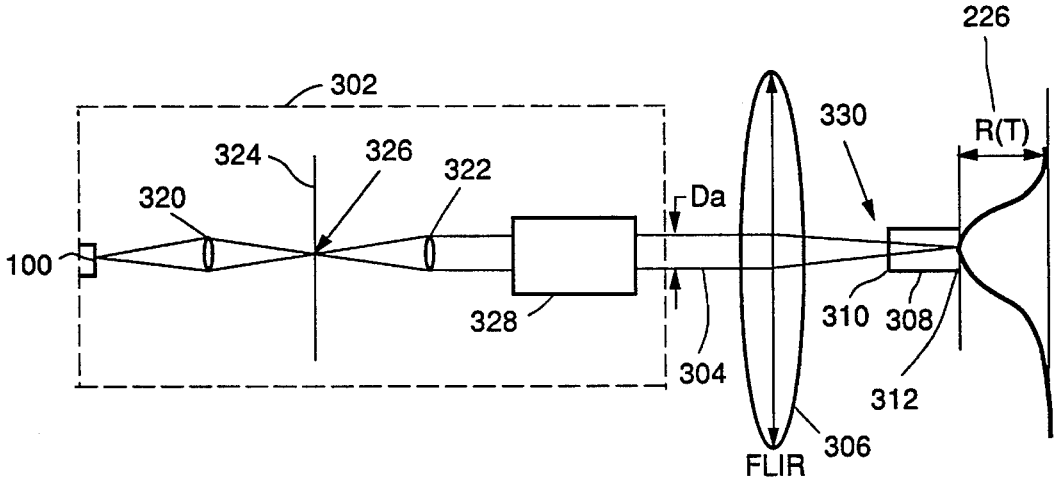

BORESIGHT THERMAL REFERENCE SOURCE

BACKGROUND OF THE INVENTION

1. Field of the Invention

This invention relates generally to a boresight thermal reference source used to provide a uniform, high intensity Long Wave Infra-Red (LWIR) beam within the 7.5–12 μ waveband in order to assure boresight alignment of laser and Forward-Looking Infra-Red (FLIR) sensor lines-of-sight. More particularly, the invention relates to a boresight thermal reference source consisting of a ceramic rod heated by a nichrome wire partially wrapped around the ceramic rod, creating a pseudo-blackbody cavity. This invention is equally applicable at other infrared wavebands, specifically the 3–5 μm waveband.

2. Description of the Related Art

The boresight thermal reference source of the present invention is used in a laser designation and thermal imaging system currently known as the AESOP program in order to permit operator initiated auto-alignment of a laser to a FLIR sensor, necessary to accurately track, lock on and fire missiles at targets. The high beam power, provided by the boresight thermal reference source, is required because the reflected boresight thermal reference source aperture at the FLIR entrance aperture subtends only 1/346 the area of the FLIR entrance pupil.

Other presently available heat sources (heat plates, halogen light bulbs, etc.) cannot become hot enough to provide the desired IR signal. $CO_2$ lasers are much too large and are very expensive. IR laser diodes are impractical because they require cooling down to 77° K. Globars are too large and require a high amount of power. While halogen light bulbs were used previously for similar applications, the temperature of a halogen bulb envelope (about 120° C.) is significantly less than that provided by the present boresight thermal reference source and less than that required in applications like the AESOP system.

The ceramic material used in the preferred embodiment of the present invention is Macor, which is easily machined. Utilization of a heated nichrome wire by itself, without the ceramic rod, lacks sufficient uniformity and emissivity for proper use. The only way to provide more heat (i.e., IR beam power) than the present design is to use higher temperature ceramics, which are more difficult to machine than Macor, and a tungsten heater wire, requiring a vacuum enclosure with a Long Wave Infra-Red (LWIR) window. This latter design, however, would be significantly more expensive than the present invention.

OBJECTS AND SUMMARY OF THE INVENTION

The present invention overcomes the pitfalls of the apparati utilized in the prior art.

It is therefore an object of the present invention to provide a boresight thermal reference source for infrared optical systems that will provide uniform, high intensity LWIR beam power within the 7.5–12 μ waveband.

Another object of the present invention is to provide an inexpensive apparatus, without utilization of vacuum, easy to machine and fast to assemble, yet producing high intensity LWIR power in the 7.5–12 μ waveband, for use as an IR reference source.

Still another object of the present invention is to provide significant LWIR beam power, necessary as a reference source representing the laser line-of-sight for the FLIR, by using a high heat and emissivity thermal source behaving as a blackbody cavity.

Yet another object of the present invention is to provide an apparatus able to locate a LWIR beam with a high degree of precision, necessary for high technology optical applications, while maintaining this precision during military shock and vibration environments.

Another object of the preferred embodiment of the present invention is to provide a thermal source small and able to accommodate a requirement of tight packaging.

Yet another object of the present invention is to provide a thermal source using low operating power.

Another object of the preferred embodiment of the present invention is to provide a thermal source which quickly reaches and maintains operating status. The device shall have a quick warm-up time, less than 20 seconds.

These objects of the present invention are realized by the boresight thermal reference source of the present invention. In accordance with the preferred embodiment of the invention, a boresight thermal reference source, capable of providing high intensity LWIR signal, is illustrated, comprising a ceramic rod and a heater wire, made of nichrome and partially wrapped with a plurality of turns around the ceramic rod, wherein an electrical current is used to heat the heater wire creating a pseudo-blackbody cavity. In the preferred embodiment, the ceramic rod is made of Macor glass-ceramic, the heater wire has 12 turns with 0.008 inches in diameter and the diameter of the ceramic rod is 0.058 inches. The blackbody cavity geometry is preserved by having the heater wire tightly wound around the ceramic rod and heat-treating the heater wire to prevent the heater wire from springing out from the ceramic rod. The ceramic rod is fixedly connected to a boresight source housing, by threading a twist wire through a plurality of holes in the boresight source housing and the ceramic rod. This same twist wire holds one end of the heater wire to the housing. Also, the bottom turn of the heater wire is threaded through a 0.013 inch diameter hole in the ceramic rod. A final means of holding the heater wire in place is the threading of both ends of the heater wire through two narrow housing slots. The ceramic rod is thinner between the area where the heater wire is wound and the area for attachment with the boresight source housing, having a diameter of 0.040 inch. The ceramic rod and heater wire coil are placed within a larger housing cavity, forming a second blackbody cavity. An electrical current of approximately 1.4 A is used to heat the heater wire to about 1000° C.

The novel features of construction and operation of the invention will be more clearly apparent during the course of the following description, reference being had to the accompanying drawings, wherein there has been illustrated a preferred form of the device of the invention and wherein like characters of reference designate like parts throughout the drawings.

BRIEF DESCRIPTION OF THE FIGURES

FIG. 1A is a top view of a boresight thermal reference source, constructed in accordance with the embodiment of the present invention;

FIG. 1B is a view taken along line 2—2 of FIG. 1A showing the boresight thermal reference source of FIG. 1A in cross sectional view;

FIG. 2 is a schematic diagram showing details of the AESOP system, incorporating the embodiment of the present invention, the boresight thermal reference source, shown in FIG. 1;

FIG. 3 is a schematic diagram showing the optics of the AESOP system, shown in FIG. 2, in simplified form in order to better describe the usefulness of the embodiment of the present invention.

DESCRIPTION OF THE PREFERRED EMBODIMENT

The following detailed description is of the best presently contemplated mode of carrying out the present invention. This description is not intended in a limiting sense, but is made solely for the purpose of illustrating the general principles of the invention.

The present invention relates to a boresight thermal reference source, used to produce infra-red signals for self-alignment of the laser to the FLIR line-of-sight. Referring now to the drawings in detail, wherein like numerals indicate like elements, there is shown in FIG. 1A and FIG. 1B, a preferred apparatus, constructed in accord with the present invention. Moreover, FIG. 2 illustrates an application of the present invention in the AESOP project.

FIG. 1A and FIG. 1B illustrate the boresight thermal reference source 100 of the preferred embodiment of the present invention, utilized in auto-alignment systems to provide a reference source having low operating power with fast warm-up, low construction cost, high uniformity and having a high intensity LWIR beam in the waveband between 7.5 μ and 12 μ. As shown in FIGS. 1A and 1B, a very small ceramic rod 102 is partially wrapped with a plurality of turns of a nichrome heater wire 104. In the preferred embodiment, ceramic rod 102 has about a 0.058 inch diameter and the nichrome heater wire 104 has preferably about a 0.008 inch diameter and is wound, preferably helically, around ceramic rod 102 with about 12 turns. The small mass of ceramic rod 102 allows for greater uniformity, quicker warm-up and lower operating power in the apparatus being described in a preferred form. The top surface of ceramic rod 102 provides a very uniformly heated target. An electrical current of about 1.4 Ampere is passed through the heater wire 104, to heat both the ceramic rod 102 and the heater wire 104 to about 1000° C. (ceramic rod 102 is probably a little cooler). The preferred ceramic Macor (a machineable ceramic), as described further below, used in ceramic rod 102 has an average emissivity of around 0.84 in the waveband of 7.5 to 12 μ.

By adding additional heater wire 104 turns extending above the top ceramic surface of ceramic rod 102, hereafter referred to as ceramic floor 108, a small blackbody cavity 106 is created. This blackbody cavity 106 effectively increases the emissivity of the ceramic floor 108 from 0.84 to nearly 1.0. The part of heater wire 104, extending above ceramic floor 108, creates the cylindrical side wall of blackbody cavity 106 of the boresight thermal reference source 100 and the flat surface of the ceramic floor 108 forms the bottom of blackbody cavity 106. The hottest top turns of the heater wire 104, above the ceramic floor 108, create additional photons in the beam, not shown, via reflection off the surface of the ceramic floor 108. Lastly, the heater wire 104 coil structure optimizes the heat at the ceramic floor 108, by having turns above and below it.

In addition, the housing cavity 114 of the boresight thermal reference source 100 behaves as a shield, wherein the partially reflecting cylindrical surface of the housing cavity 116 creates a hotter heater wire 104 and thus a hotter boresight thermal reference source 100. The shielding from the housing cavity 114, as well as the effects of the blackbody cavity 106, thus collectively increase the power of the IR reference signal 202 with minimal heater operating power.

The blackbody cavity 106 geometry is preserved by having the heater wire 104 tightly wound around the ceramic rod 102 and heat-treated, to prevent the heater wire 104 from springing out from the ceramic rod 102. In order to achieve a tight fit around the ceramic rod 102, the heater wire 104 is first wound around a smaller diameter rod, such as a 0.54 inch diameter drill bit, and then transferred to the ceramic rod 102. The heat-treating of the heater wire 104 before assembly is accomplished in a vacuum furnace at approximately 1065° Centigrade for 30 minutes, or by running 1.5 A of current through the heater wire 104 for 60 seconds (note that the ceramic rod 102 cannot be placed in the vacuum furnace because the Macor ceramic will melt if above 1000° Centigrade for too long). Also, a second heat treatment occurs during assemblage with the housing cavity 114, whereby a current of 1.45 A is run through the heater wire 104. During both heat treatments, the coiled heater wire 104 is gently pressed to reduce the gaps between turns. Reducing these turn-to-turn gaps helps maintain the wall structure of the blackbody cavity 106.

Moreover, the heater wire 104 is maintained in position, preserving the blackbody geometry, by threading the bottom turn through a hole, herein named heater wire hole 118, in the upper part of the ceramic rod 102. Finally, two narrow housing slots 122 are also used to keep the heater wire in position.

The ceramic rod 102 is fixedly connected to a boresight source housing 110 (housing 110 is also preferably made of Macor ceramic). The ceramic rod 102 is precisely located to the boresight source housing 110 by means of a close fit between the bottom diameter of the ceramic rod 102 and a precision bore within the boresight source housing 110. Firm attachment of the ceramic rod 102 to the boresight source housing 110 is accomplished by threading a piece of twist wire 120 through the housing and ceramic rod hole 112. This housing and ceramic rod hole 112 extends from one boresight source housing 110 side through the bottom end of the ceramic rod 102 and finally through the other side of the boresight source housing 110. In addition, this same twist wire 120 pins one end of the heater wire 104 to the housing so that the heater wire 104 top turns cannot move. The boresight thermal reference source 100 is easily reworkable in the sense that the ceramic rod 102 and heater wire 104 (the two components most susceptible to damage) can be easily replaced by cutting and removal of the twist wire 120.

The heat loss is kept to the minimum by making the ceramic rod 102 thinner below the area where the heater wire 104 is wound, as shown in FIG. 1B, namely 0.12 inch long and 0.040 inch diameter in the preferred embodiment, although some heat is lost through conduction from the blackbody cavity ceramic floor 108 to the floor of the housing cavity 114. The ceramic rod 102 is made, in the preferred embodiment, of Macor glass-ceramic, available from Corning Glass Works, Coming, N.Y. 14830.

FIG. 2 illustrates an application of the present invention in the AESOP system 200, where the parallelism between a laser beam 204 and a FLIR line of sight (hereafter referred to as an FLIR input signal 220) must be maintained by utilization of a reference beam. The reference beam, hereafter referred to as boresight source infrared reference signal 202, is created by the boresight thermal reference source 100 found within the laser and thermal reference source 206.

In FIG. 3 is illustrated how the boresight source infrared reference signal 202 is created within the laser and thermal reference source 206. The infrared energy from the hot boresight thermal reference source 100 is gathered via collecting optics 320 and imaged at a pinhole 326 found on a field stop 324. The image at the pinhole is then collimated by the collimating optics 322. The collimated signal at this point has a 8 mrad subtense diameter, which equates to a field stop pinhole of 4 mils and an effective focal length of 0.5 inches ($f_c$ in FIG. 3). In FIG. 2, one sees the collimated signal exiting the laser and thermal reference source 206 and then transformed into a 1.28 mrad (unblurred) subtense diameter target after passing through the 6.25 x beam expander 216 (i.e., 1.28 mrad=8 mrad/6.25).

Not shown in FIGS. 2 or 3 is that the boresight source infrared reference signal 202 is accurately aligned to a laser beam 204 within the laser and thermal reference source 206. Continuing in FIG. 2, one sees that this aligned laser beam and boresight source infrared reference signal 202 run along the same path (but not at the same time) and, are reflected from a laser 2-axis mirror 214, directed through a beam expander 216, which in the preferred embodiment expands 6.25 x and on through a laser window 230. Both the FLIR input signal 220 and the laser beam 204 do not exist during the boresight operation shown in FIG. 2. The potential direction (i.e., if the retro-reflector 218 was not in the way) of the FLIR input signal 220 and the laser beam 204 are shown in FIG. 2 for the sole purpose of understanding the alignment procedure. During normal operation, not boresighting, not shown, the gimbaled ball 232 is rotated away from the retro-reflector 218 so that the incoming FLIR input signal 220 can enter the unblocked FLIR telescope objective 228. During normal operation is when the AESOP system 220 can track, lock on target and fire the laser beam 204.

During the boresight operation in FIG. 2, the gimbaled ball 232 rotates to align with the retro-reflector 218, having a 1.016 cm aperture in the preferred embodiment, which directs the boresight IR reference signal 202 back to the FLIR 210 through the FLIR telescope objective 228 in a path potentially parallel with the laser beam 204 (i.e., in a path parallel to the laser beam 204 if it was on, though in this particular situation it is not on). The FLIR 210 sees the unblurred 1.28 mrad diameter boresight source IR reference signal 202 as a 2.7 mrad blurred boresight source IR reference signal 212. Blurring occurs because of diffraction, since the 1.28 mrad unblurred diameter is less than the Airy Disc diameter of 2.314 mrad. Note that the Airy Disc diameter of 2.314 mrad equates to 0.244 $\lambda/D$, where $\lambda$=wavelength of 9.64 microns and D=retro-reflector 218 aperture of 1.016 cm.

During the boresight operation in FIG. 2, the boresight thermal reference source 100 is turned on for 30 seconds. If the centroid of the blurred boresight source IR reference signal 212 is not in the center of the tracking reticle (box used for locating and locking on to the FLIR input signal 220 target), then the tracking reticle is moved to make it so. In addition, a fine adjustment to the laser 2-axis mirror 214 position is made to exactly align the IR reference signal 202 (and potential laser beam 204) to the potential FLIR input signal 220. The tracking reticle position and the laser 2-axis mirror 214 position is then saved via software and is used when locking onto and firing at targets during normal operation.

In order to provide good tracking of the boresight thermal reference source 100, the peak FLIR response signal 226 of at least 125 mV, equivalent to 2° C. change in FLIR input signal 220, must be obtained in less than 20 seconds after turn on, and the blurred boresight source IR reference signal 212 must be less than 4 mrad in diameter (measured at 10% points). The high heat and emissivity provided by the boresight thermal reference source 100 are required mostly because the retro-reflector 218 aperture ($D_a$ in FIG. 3) is much smaller than the entrance pupil ($D_f$ in FIG. 3) of the FLIR 210 (1/346 of the area and thus 1/346 of the signal). Also, diffraction and transmission losses from the boresight source optical system 302, shown in FIG. 3 and described below, further degrades the FLIR response signal 226 by a factor of at least 3.7.

The IR reference signal 202, produced in the boresight thermal reference source 100, is passed through a boresight source optics system 302, as presented in FIG. 3, used to create a collimated boresight source IR reference signal 304. The boresight source optical system 302 consists of a collecting optics 320, a collimating optics 322, a field stop 324 with a pinhole 326 and the beam expander and retro-reflector system 328. The collimated boresight source IR reference signal 304 is passed through FLIR optics 306, presented in detail in FIG. 2, and a detector dewar 308, having a dewar window 310 and a dewar detector array 312. The FLIR response signal 226 (response in x-direction versus scan time in y-direction), is shown at the exit of the dewar 308. The FLIR response signal 226 is a result of the scanner 208 scanning through the center of the blurred boresight source IR reference signal 212.

The present invention, the boresight thermal reference source for LWIR optical systems, provides uniform, high intensity LWIR power over the waveband between 7.5–12 μ. The beam can be used as an IR reference beam, necessary as a reference signal for the FLIR and representing the direction of the laser in the AESOP system 200. The apparatus is inexpensive, does not need utilization of vacuum, uses Macor ceramic which is easily machined (especially the ceramic rod 102 which is cylindrical) and is fast to assemble since it takes less than one hour. The apparatus provides a thermal source which is small and able to accommodate a requirement of tight packaging, fast response (less than 20 second warm up), and uses low operating power of less than 10 watts.

By having the ceramic rod 102 source firmly attached to the boresight source housing 110, the apparatus is able to precisely position the LWIR beam toward the pinhole 326. Since most of the signal generated in the FLIR 210 comes from a 4 mil diameter spot on the center of a 58 mil diameter uniformly heated ceramic floor 108, movement of the boresight thermal reference source 100 during vibration or shock will not change the position of the FLIR response signal 226.

Testing of The Boresight Thermal Reference Source

Implementation of the boresight thermal reference source 100, described in the preferred embodiment of the invention, was accomplished using the AESOP system 200, as presented in FIG. 2. The latest version of the boresight thermal reference source 100, wherein the ceramic rod 102 is attached to the boresight source housing 110, has not been fully tested. However, a very similar design (the main difference being that the ceramic rod 102 was not attached to the housing) was used on the first two AESOP systems 200 and in a third laser system, and the results obtained show that the boresight thermal reference source 100 behaves according to the specifications and requirements.

The objectives of the tests were to evaluate the boresight thermal reference source 100 overall performance. The testing consisted of measuring the peak FLIR response signal 226 intensity, size and uniformity of the blurred boresight source IR reference signal 212.

The following AESOP system components and test equipment were utilized:

1. Power supplies for the FLIR 210 and boresight thermal reference source 100;

2. AESOP FLIR optics 306, scanner 208, and FLIR 210 (FLIR 210 is really the imager optics, not shown, detector 330 and electronics, also not shown) mounted in the gimbaled ball 232, AESOP digital scan converter, not shown (for processing of video signals);

3. Mirrors and HeNe lasers for alignment, not shown;

4. One of three optical systems listed below;

5. Adjustable aperture to simulate the retro-reflector 218 aperture;

6. Breakout boxes, not shown, to intercept the FLIP, response signal 226 before video processing;

7. Oscilloscope, not shown, to measure FLIR response signal 226 in mV;

8. TV monitor, not shown.

Tests determining the peak FLIR response signal 226 and the diameter of the blurred boresight source IR reference signal 212 are performed as follows: the FLIR 210 and the boresight thermal reference source 100 are first powered up. The gimbaled ball 232 is then rotated until the blurred boresight source IR reference signal 212 is centered in the video (within the dewar detector array 312 channels 61 to 100 out of 160 detector dewar array 312 channels). The correct signals from the breakout box (signals are also controlled via system software) are then fed into the oscilloscope.

The test set-up for measuring uniformity requires all of the above plus the monitoring of the tracking signal error, a signal which comes from the video processing part of the system, not shown. The tracking signal error is proportional to the distance between the centroid of the blurred boresight source IR reference signal 212 and the exact center of the video. Under normal operation the information from the tracking signal error is used to correct the reticle and laser 2 axis mirror 214 position during the boresight operation.

The testing was done using three different optical set-ups, each time with a 1.016 cm aperture at the FLIR's entrance pupil:

1. Using optics to simulate the boresight source optics, wherein a simulator consisted of collecting optics, field stop and collimating optics;

2. Using the laser's boresight thermal reference source 100, collecting optics 320 and collimating optics 322 with a Sorell beam expander, not shown; and 3. Using the actual AESOP system 200.

The simulator uses a larger pinhole subtense and optics with more than double the transmission of the actual system thereby resulting in a much larger FLIR response signal 226. Using the simulator and the AESOP FLIR 210, the FLIR response signal 226 of about 830 mV was achieved. The boresight thermal reference source 100 heater wire 104 current and voltage used were 1.4 A and 5 V, which corresponds to 7 watts. Using the Sorell beam expander resulted in a FLIR response signal 226 of about 220 mV for the first two AESOP systems 200 and about 270 mV for the third laser ('laser' throughout this section on testing refers to boresight thermal reference source 100, collecting optics 320, and collimating optics 322). This increase in signal is due to the fact that the third laser eliminated a source of vignetting which was experienced in the first two systems. The amplitude of the FLIR response signal 226, seen in the first two AESOP systems, was about 168 mV. The system, using the third laser, would probably achieve an amplitude of about 206 mV, based on the improvement seen with the third laser. Note that in every case, at least 90% of the signal was achieved in 20 seconds.

The latest design, presented in the preferred embodiment of the present invention and having the ceramic rod 102 attached to the boresight source housing 110, will probably result in a signal that is about 10% less than the FLIR response signal 226 obtained from the third laser system, due to conduction heat loss induced by attaching the ceramic rod 102 to the floor of the boresight source housing 110. However, the attachment is necessary in order to precisely locate the heat source in production. This estimate was based on approximately 20% loss seen when comparing the latest design (except diameter of the ceramic floor 108 was 0.070 inch rather than 0.058 inch, and the length of the skinnier region of the ceramic rod 102 was 0.10 inch rather than 0.12 inch) to the design used in the AESOP system 200. This testing utilized the optics in set-up 1 above in February 1994.

The current can be raised to 1.5 A, if an increase in sensor output is desired, but this will increase the temperature of the Macor ceramic to its melting point of 1000° C., and will increase the nichrome wire temperature above 1000° C., which goes beyond the recommended temperature to prevent excessive oxidation. Even without these modifications it is obvious that the minimum requirements of the boresight thermal reference source 100 with at least 125 mV FLIR response signal, required for good tracking, will be easily met. With a similar design, approximately 168 mV has been demonstrated. This value was low due to some vignetting which occurred in the first two systems. More detailed calculations, not shown here, suggest that 200 mV may be the actual theoretical maximum.

In addition, in order to test the uniformity of the boresight source target, the boresight thermal reference source 100 was moved back and forth up to 29 mils, which is more than should ever be experienced due to shock or vibration, while monitoring centroid tracking error. Tracking errors corresponding to less than 20 μrad were observed.

In conclusion, the assembly and testing has proven that the boresight thermal reference source 100 of the preferred embodiment of the present invention is easy to manufacture and use and requires low maintenance, while providing fast warm-up capability in an almost hands-off boresighting operation.

The invention described above is, of course, susceptible to many variations, modifications and changes, all of which are within the skill of the art. The aforementioned infrared boresight thermal reference source is applicable over multiple wavelength bands, including the 3–5 μm band. For example, the boresight thermal reference can be used in conjunction with a FLIR operating in the 3–5 μm and an associated laser rangefinder/designator. It should be understood that all such variations, modifications and changes are within the spirit and scope of the invention and of the appended claims. Similarly, it will be understood that Applicant intends to cover and claim all changes, modifications and variations of the example of the preferred embodiment of the invention herein disclosed for the purpose of illustration, which do not constitute departures from the spirit and scope of the present invention.

What is claimed is:

1. A boresight thermal reference source capable of providing a high intensity Infra-Red signal, comprising:

a hollow boresight source housing;

a ceramic rod mounted in the interior of said housing; and, a heater wire helically surrounding, at least partially, said ceramic rod, and having a plurality of turns extending outwardly from a top end of said ceramic rod to form a blackbody cavity therein from said plurality of outwardly extending turns and said ceramic rod.

2. The boresight thermal reference source of claim 1, wherein said ceramic rod and said boresight source housing are fabricated of machinable glass-ceramic material.

3. The boresight thermal reference source of claim 1, wherein said heater wire is fabricated from nichrome, and has a diameter of about 0.006 to 0.010 inches, and is helically wound in turns, at least some of which turns extend outwardly from one end of said ceramic rod thereby creating said blackbody cavity.

4. The boresight thermal reference source of claim 1, wherein the diameter of said ceramic rod is about 0.038 to 0.068 inches in order to more uniformly heat the top of the ceramic rod with minimal heater power.

5. The boresight thermal reference source of claim 1, wherein an electrical current of approximately 1.4 Ampere is utilized to heat said heater wire and said top end of said ceramic rod to about 1000° C.

6. The boresight thermal reference source of claim 1, wherein said heater wire is tightly wound around said ceramic rod, and is heat-treated to prevent said heater wire from springing out from contact with said ceramic rod.

7. The boresight thermal reference source of claim 6, wherein said heater wire is heat-treated before assembly in a vacuum furnace at approximately 1065° C. for 30 minutes while pressing both ends of said coiled heater wire to eliminate gaps between turns.

8. The boresight thermal reference source of claim 6, wherein said heater wire is heat-treated by running an electrical current of approximately 1.5 Ampere through said heater wire for about 60 seconds while pressing both ends of said coiled heater wire to eliminate gaps between turns.

9. The boresight thermal reference source of claim 1, wherein said ceramic rod and one end of said heater wire are fixedly connected to a boresight source housing for precise location by being tightly fitted thereto and to prevent motion of said heater wire and said ceramic rod.

10. The boresight thermal reference source of claim 9, wherein the fixed attachment of said ceramic rod to said boresight source housing is accomplished by threading a twist wire through a plurality of holes formed in said boresight source housing and said ceramic rod.

11. The boresight thermal reference source of claim 9, wherein one end of said heater wire is held tightly to said boresight source housing by having said twist wire wrapped over the leading portion of said heater wire.

12. The boresight thermal reference source of claim 1, wherein a plurality of narrow housing slots are formed in said boresight source housing to constrain further said heater wire.

13. The boresight thermal reference source of claim 1, wherein the fixed attachment of said heater wire to said ceramic rod is accomplished by threading the bottom turn of said heater wire through a hole, having a diameter of about 0.013 inch, formed in said ceramic rod.

14. The boresight thermal reference source of claim 1, wherein said ceramic rod and said heater wire are placed in a second housing cavity adapted to at least partially provide shielding.

15. The boresight thermal reference source of claim 1, wherein said coiled heater wire structure optimizes the heat at the end of said ceramic rod by having turns of said heater wire both below and extending from the end of said ceramic rod.

16. The boresight thermal reference source of claim 1, wherein said ceramic rod is thinner, about 0.030 to 0.050 inches in diameter over a length of about 0.09 to 0.15 inches, between the area where said heater wire is wound and the area for attachment with said boresight source housing in order to reduce loss from heat conduction.

* * * * *